US006517187B1

(12) United States Patent
Dietl et al.

(10) Patent No.: US 6,517,187 B1
(45) Date of Patent: Feb. 11, 2003

(54) METHOD AND APPARATUS FOR CLEANING RESIDUAL INK FROM PRINTHEAD NOZZLE FACES

(75) Inventors: Steven J. Dietl, Ontario, NY (US); David Cipolla, Macedon, NY (US); Michael S. Defilippis, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/951,316

(22) Filed: Sep. 14, 2001

(51) Int. Cl.[7] ..... B41J 2/165
(52) U.S. Cl. ..... 347/33
(58) Field of Search ..... 347/22, 29–33, 347/36

(56) References Cited

U.S. PATENT DOCUMENTS

| | | | | |
|---|---|---|---|---|
| 4,771,295 A | | 9/1988 | Baker et al. | 346/1.1 |
| 4,849,774 A | | 7/1989 | Endo et al. | 346/140 R |
| 5,073,785 A | | 12/1991 | Jansen et al. | 346/1.1 |
| 5,381,169 A | * | 1/1995 | Arai et al. | 347/33 |
| 5,404,158 A | | 4/1995 | Carlotta et al. | 347/32 |
| 5,774,139 A | * | 6/1998 | Salzer et al. | 347/32 |
| 5,971,531 A | | 10/1999 | Dietl et al. | 347/86 |
| 5,984,452 A | * | 11/1999 | Bekki | 347/33 |
| 6,189,999 B1 | * | 2/2001 | Pham et al. | 347/33 |

* cited by examiner

*Primary Examiner*—Raquel Yvette Gordon
*Assistant Examiner*—An H. Do
(74) *Attorney, Agent, or Firm*—Robert Chittum

(57) ABSTRACT

A positionable wiper blade is positioned by a translatable carriage contact and clean a printhead nozzle face. The carriage translates a removable ink tank support structure with an attached ink jet printhead from a printing location to a non-printing location where the positionable wiper blade is located. A replaceable ink supply tank is installed on the support structure and replaced when the ink is depleted. The wiper blade is moved into wiping position by movement of the carriage and when the carriage is translated away from the non-printing location towards the printing location, the wiper blade cleans the printhead nozzle face and flicks the ink removed from the nozzle face into a backstop receptacle. Continued translation by the carriage moves the wiper blade into contact with the backstop receptacle, which then cleans the wiper blade, and subsequently positions the wiper blade away from the wiping position when the carriage returns to the non-printing location, so that the wiper blade does not contact the backstop receptacle until after it cleans the printhead nozzle face.

10 Claims, 4 Drawing Sheets

METHOD AND APPARATUS FOR CLEANING RESIDUAL INK FROM PRINTHEAD NOZZLE FACES

BACKGROUND OF THE INVENTION

The present invention relates to thermal ink jet printheads and more particularly, to a method and apparatus for the removal of residual ink collected on the printhead nozzle face during a printing operation by using a wiper blade and a backstop receptacle to collect the residual ink flicked from the wiper blade and to clean the wiper blade. Inadequate cleaning of the residual ink from the printhead nozzle face will result in misdirected ink droplets and subsequent print quality defects by the printhead. Inadequate cleaning of the wiper blade results in recontaminating the nozzle face with residual ink, while residual ink removed from nozzle faces by wiper blades usually flick the residual ink around resulting in the contamination of the platen holding the printing medium and the printing medium.

Thermal ink jet printing systems use thermal energy pulses generated by the heating elements in an ink jet printhead to produce momentary ink vapor bubbles on the heating elements which eject ink droplets from the printhead nozzles. One type of such a printhead has a plurality of parallel ink channels, each communicating at one end with an ink reservoir and having opposing open ends which serve as nozzles on the droplet emitting face of the printhead. A heating element, usually a resistor, is located in each of the ink channels a predetermined distance upstream from the nozzle openings. The heating elements are individually driven with a current pulse to momentarily vaporize the ink and form a bubble which expels a droplet of ink. A meniscus is formed at each nozzle under a slight negative pressure to prevent ink from weeping therefrom.

One method of fabricating an ink jet printhead having a plurality of droplet emitting nozzles therein, consists of combining an upper substrate containing one or more ink reservoirs, a lower substrate having an array of heating elements on one surface thereof, and a patterned layer of polyimide between the upper and lower substrates. The substrates, when aligned and bonded with the patterned layer of polyimide therebetween, define ink channels which are in fluid communication with the ink reservoirs at one end and are open at the other end to serve as nozzles in what are referred to as nozzle faces or front faces. The operation of a typical thermal ink jet printer is described, for example, in U.S. Pat. No. 4,849,774.

Once the individual printheads have been separated from the bonded silicon wafers by a dicing operation, the front faces thereof can be plasma cleaned to remove any polyimide debris that has been smeared in or around the nozzles by the dicing operation. Next, an amorphous or diamond like carbon (DLC) coating can be deposited on the front face of the printheads and subsequently fluorinated as in U.S. Pat. No. 5,073,785 to provide for a hydrophobic surface which prevents ink from accumulating around the nozzles and affecting the trajectory of ink droplets expelled from the nozzles.

The carriage type ink jet printer of which the present invention relates typically has one or more small printheads containing the ink channels and nozzles in a nozzle face. The printheads are combined with ink supply tanks to form an ink cartridge. In one type of cartridge, the printhead and one or more ink tanks are an integral part thereof and the entire cartridge is disposable when the ink in the tanks is depleted.

In another type of cartridge, the printhead is an integral part of a replaceable ink tank support and replaceable ink supply tanks are inserted into the ink tank support. Generally, the ink tank support is first installed on the printer's translatable carriage and then the ink tanks are installed. If the ink jet printer is a multicolor type, the replaceable ink tank support should not need to be replaced until at least ten ink supply tanks of the same color ink are depleted of ink during printing operations. Whether the carriage type ink jet printer uses replaceable ink cartridges with integral printheads that are installed on the printer's carriage and disposed of when depleted of ink or replaceable ink tank supports with integral printheads that are installed on the printer's carriage with separate replaceable ink supply tanks installed in the ink tank support, both types are translated in a printing zone in one direction to print a swath of information on a recording medium, such as paper. The swath height is equal to the length of the column of nozzles in the printhead's nozzle face. The paper is held stationary during the printing and, after the swath is printed the paper is stepped a distance equal to the height of the printed swath or a portion thereof. This procedure is repeated until the entire page is printed. For an example of typical ink jet cartridges, refer to U.S. Pat. No. 4,771,295 for disposable ink tanks with integral printheads, and refer to U.S. Pat. No. 5,971,531 for replaceable ink tank supports with integral printheads and separate replaceable ink supply tanks.

As is well known, the ink jet printheads of the carriage type printers require maintenance usually at a maintenance station located to one side of the printing zone, where the printhead nozzle faces are periodically cleaned during and after a printing operation and capped to prevent the ink in the nozzles from drying out when the printer is not printing. In addition, the printhead may be primed while capped to ensure that the printhead channels are completely filled with ink and contain no print inhibiting air bubbles. The cleaning of the printhead nozzle faces are generally accomplished by using wiper blades which wipe the nozzle faces as they enter and/or leave the maintenance station. Refer to U.S. Pat. No. 5,404,158 for a typical maintenance station.

As disclosed above and in conventional carriage type ink jet printers, wiper blade cleaning of printhead nozzle faces by using the carriage motion to move the printhead nozzle face past a fixed wiper blade are well known. However, a key element to adequate cleaning is the use of appropriate high pressure contact of the wiper blade with the nozzle face. This is necessary to prevent 'hydroplaning' which leaves a film of ink and ensures sufficient wiping off of the residual ink which tends to accumulate on the nozzle face during printing. Unfortunately, high pressure contact of the wiper blade with the nozzle face results in stored energy in the deformed wiper blade as it wipes across the nozzle face, so that when the wiper blade breaks contact with the nozzle face at the end of the wiping operation, the stored energy in the wiper blade causes the ink cleaned from the nozzle face to be flicked or catapulted from the wiper blade. This flicked ink splatters onto the carriage and printing platen and any build up of ink on printer parts adjacent the paper can contact the paper and cause printed image smear. This invention solves the problem of both flicked residual ink from the wiper blade and the cleaning of the wiper blade itself.

SUMMARY OF THE INVENTION

It is an object of the present invention to provide for more effective cleaning of residual ink from the printhead nozzle face by a combination of printhead wiper blade and backstop receptacle which collects residual ink removed by the wiper blade and cleans the wiper blade.

In one aspect of the invention, there is provided a method of removing residual ink from an ink jet printhead nozzle face with a wiper blade, collecting residual ink removed, and cleaning residual ink from said wiper blade, comprising the steps of: moving the printhead nozzle face in a first direction passed a relatively stiff wiper blade, so that the wiper blade contacts said nozzle face and is flexingly deformed thereby; removing the residual ink from said nozzle face and at least partially onto said flexingly deformed wiper blade as said wiper blade is moved past said nozzle face, thereby wiping said nozzle face clean; flicking at least some of the removed residual ink from said wiper blade as said wiper blade is moved out of contact with said nozzle face, whereby said wiper blade straightens out from being flexingly deformed; collecting said at least some of the residual ink flicked from said wiper blade into a backstop receptacle; and continuing to move the nozzle face is said first direction until said wiper blade is placed into flexingly deformed contact said backstop receptacle, so that a portion of said wiper blade is wiped against the backstop receptacle, thereby cleaning all remaining residual ink therefrom.

In another aspect of the invention, there is provided in an ink jet printer having a translatable printhead with nozzles in a nozzle face from which ink droplets are ejected therefrom, said printer having means to translate the printhead, a wiper blade means for removing residual ink from the printhead nozzle face, and means for both collecting removed residual ink and cleaning the wiper blade means, comprising: said wiper means including a wiper blade fixedly mounted at one end in a positionable blade holder and having a free, opposing distal end for cleaning the nozzle face; said printhead being attached to a removable ink tank support structure, said structure being selectively translated between a printing location and a non-printing location; said positionable holder being located adjacent the non-printing location and being extendably positionable from a non-cleaning position to a cleaning position; means for selectively moving said positionable holder from said non-cleaning position to said cleaning position and returning the holder to said non-cleaning position, so that said wiper blade distal end relatively stiffly contacts the printhead nozzle face and is deformed thereby, when the ink tank structure with the printhead is translated from the non-printing location to said printing location, the wiper blade distal end wiping residual ink from the nozzle face during deformed contact therewith as said ink tank structure is being translated; a backstop receptacle for collecting residual ink flicked from the distal end of the wiper blade when the ink tank structure is translated toward the printing location from the non-printing location and said deformed wiper blade is moved out of contact with the nozzle face thus enabling the wiper blade distal end to straighten out after being deformed during contact with the printhead nozzle face; and said wiper blade distal end contacting the backstop receptacle as the ink tank structure continues translation from the non-printing location, thereby cleaning the remaining residual ink therefrom into said backstop receptacle.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
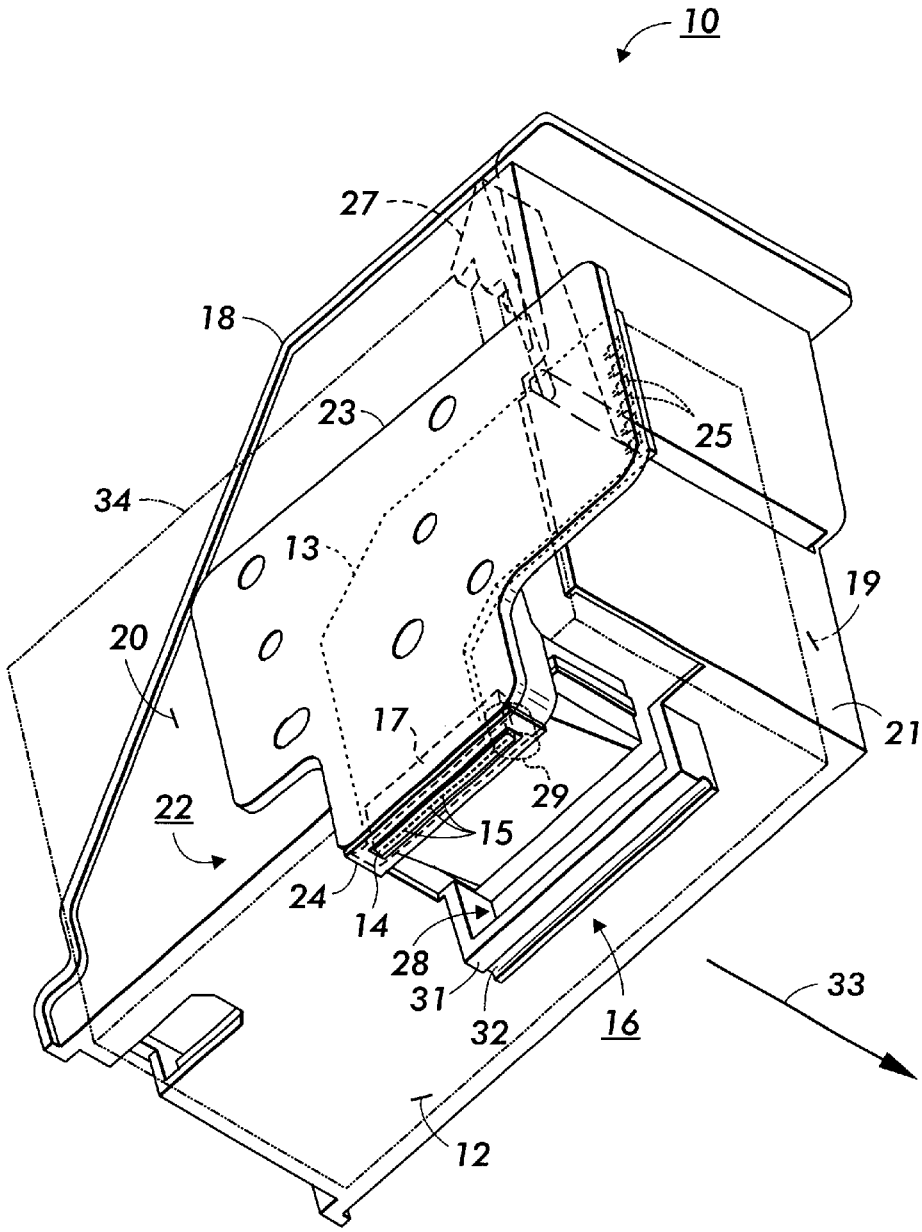
FIG. 1 is a schematic isometric view of an ink tank support structure with a backstop receptacle for use in an ink jet printer in accordance with the present invention.

In FIG. 1, a schematic isometric view of an ink tank support structure 10 of the present invention is shown in an orientation that shows the bottom wall 12 thereof and printhead nozzle face 14 with array of droplet emitting nozzles 15 therein. In this view, a backstop receptacle 16 is shown integrally formed on the exterior surface of the ink bottom wall of the ink tank support structure and spaced from the printhead 17 which is shown in dashed line. The ink tank support structure shown is configured for the installation of a black ink supply tank 34 therein, shown in phantom line. The ink tank support structure of the present invention comprises a housing 18 having side walls 19 and 20, bottom wall 12, and back wall 21. Attached to side wall 20 is a printhead assembly 22, comprising the printhead 17, interfacing circuit board 13 (shown in dashed line) and heat sink 23. The interfacing circuit board contains contact pads 25 (shown in dashed line) for electrically connecting the printhead to the printer controller (not shown) via the translating carriage 26 (see FIG. 2) when the ink tank support structure is installed on the translating carriage 26 of the ink jet printer (not shown). A thin frame member 24 of suitable material, such as, for example, Mylar, surrounds the printhead nozzle face and is coplanar therewith to aid in the cleaning of the nozzle face and reduce wear on the wiper blade 30, shown in FIG. 2. The wiper blade is used to keep the nozzle face clean, as discussed later. The housing 18 has an ink pipe connector 29 which protrudes from the inner surface of the housing bottom wall for insertion into a black ink supply tank when it is installed into the ink tank support. An ink flow path (not shown) is formed in the housing bottom wall and interconnects the ink supply tank via the ink pipe connector and ink flow path to the printhead.

The housing 18 of the ink tank support structure 10 of the present invention is preferably produced by injection molding using any suitable material, such as, for example, polypropylene. An integral latching arm 27 extends from the back wall 21 at an acute angle to the back wall and to the interior thereof. The latching arm is flexible and is used to fasten the black ink supply tank 34 in place when it is installed in the ink tank support structure. The backstop receptacle 16 has a rectangular box shape with an open side 28 confronting the printhead. The top wall 31 of the backstop receptacle is substantially parallel to the bottom wall of the ink tank support structure and has a groove 32 in its outer surface which is perpendicular to the direction of translation of the carriage, shown as arrow 33.

Figure 2:
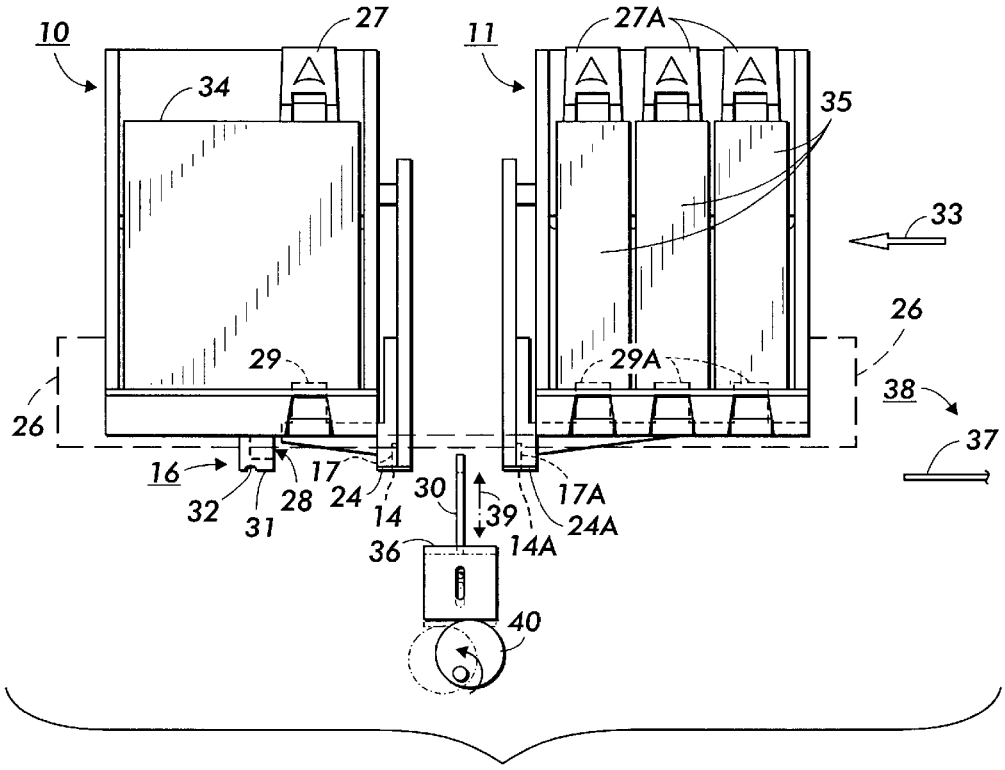
FIG. 2 is a schematic elevation view of two ink tank support structures, one of which is shown in FIG. 1, one ink tank structure having an ink supply tank containing black ink and the other having an ink supply tank containing color inks, both are shown mounted on a translatable carriage shown in dashed line with the carriage being located in a non-printing position where the positonable holder with wiper blade mounted thereon is located in accordance with the present invention.

Referring to FIG. 2, a schematic elevation view of a translatable carriage 26 of an ink jet printer (not shown) is depicted in dashed line. The carriage has installed thereon one ink tank support structure 10 for a replaceable black ink tank 34 and one ink tank support structure 11 for separate replaceable multicolor ink tanks 35, which may also be one integral tank containing separate chambers (not shown), each tank or chamber having respective cyan, magenta, and yellow inks therein. The ends of respective latching arms 27, 27A lock the respective ink tanks 34,35 in place on their respective ink tank support structures 10,11 with the respective ink pipe connectors 29,29A inserted therein. The positionable wiper blade holder 36 is mounted at a non-printing location to one side of the printing location 38 where the recording medium, such as paper 37 is held on a platen (not shown). The wiper blade holder a has replaceably mounted wiper blade 30 therein. When the printhead nozzle face 14 requires removal of black residual ink thereon, which is produced by droplet ejection during printing operations, the carriage 26 is translated from the printing location 38 to the non-printing location which has the wiper blade mounted in the positionable holder 36, as indicated by arrow 33.

The determination of the time to clean residual ink from the printhead nozzle face may by accomplished in any well known suitable way, such as by a particularly set time period for a printing operation, so that the operating application software loaded into the printer controller (not shown) would automatically send the printhead to the non-printing location at the appropriate times for cleaning. The movement of the carriage causes the positionable holder 36 to elevate from a non-wiping position to a wiping position by any suitable means such as, for example, by sled cams and the like (not shown) but represented by circular cam 40 which moves the holder and wiper blade towards and away from the carriage as indicated by arrow 39. Alternatively, the positionable holder 36 could be spring biased into the wiping position and withdrawn by a camming operation by the carriage long enough to permit the carriage 26 to move past the wiper blade 30 until the wiper blade could be positioned between the two ink tank support structures 10, 11, as shown in FIG. 2, so that the wiper blade is not damaged by unnecessarily contacting the backstop receptacle 16 prior to cleaning the printhead nozzle face 14.

Figure 3:
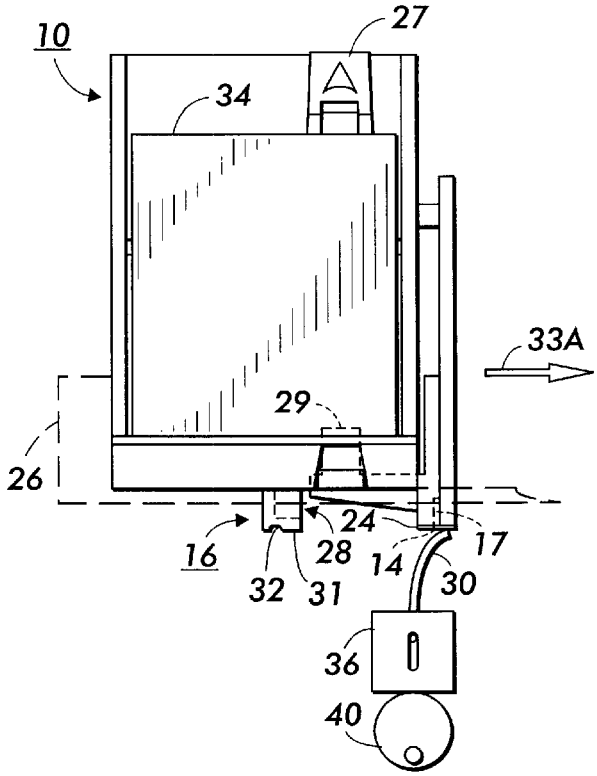
FIG. 3 is a partially shown elevation view of similar to FIG. 2 showing only the ink tank structure with ink supply tank having the black ink and the carriage being translated in a direction towards the printing position and depicting the wiper blade in wiping contact with the printhead nozzle face.

In FIG. 3, a partially shown elevation view similar to that of FIG. 2 is depicted, showing only the ink tank support structure 10 and ink tank 34 with the carriage 26 being translated from the non-printing location towards the printing location, as indicated by arrow 33*a*. The movement of the carriage brings the relatively stiff wiper blade 30 into contact with the frame member 24 which surrounds the printhead nozzle face and causes the wiper blade to be flexingly deformed. The wiper blade is constructed of a suitable resilient material which is not damaged by the ink used in the black ink tank 34, such as, for example, rubber or neoprene, and has a shore A durometer which provides a suitably stiff material, so that the wiper blade is placed into a suitably high pressure contact with the printhead nozzle face. This high pressure contact prevents a hydroplaning of the wiper blade, which would result in the leaving of a thin film of residual ink, and ensures an adequate wiping of the printhead nozzle face. This is well known in the industry, but, unfortunately, the required high pressure contact of the wiper blade results in the flicking or flinging of the removed residual ink as soon as the wiper blade contact is released from contact with the printhead nozzle face. Thus, the adequate contact pressure to ensure proper cleaning of the printhead nozzle face produces ink splatter on the carriage and surrounding vicinity, which leads to ink smear on the printed recording medium or paper.

Figure 4:
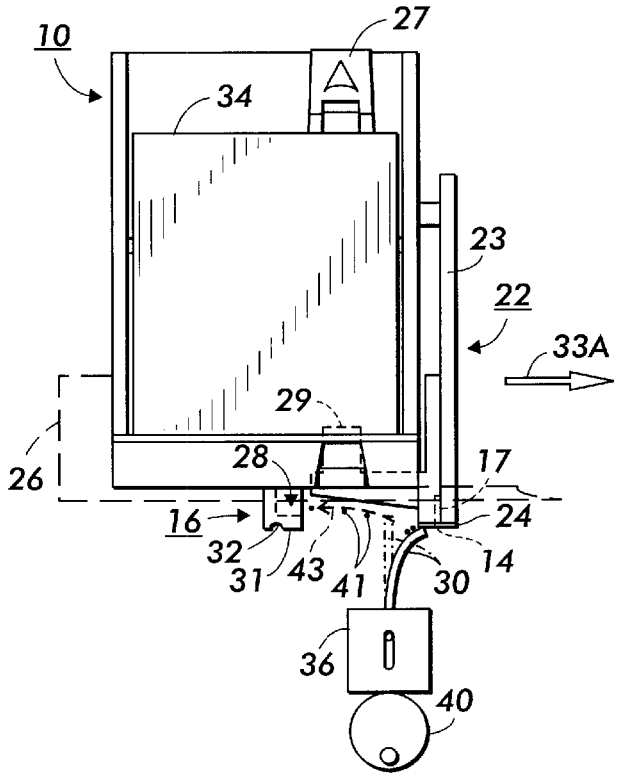
FIG. 4 is a view similar to FIG. 3 showing the position of the carriage where the wiper blade has finished cleaning the nozzle face and just prior to leaving contact therewith and immediately after contact with the nozzle face shown in dashed line so that ink is flicked into the backstop receptacle.

Referring to FIG. 4, this problem of flicking residual ink 41 from the wiper blade at the end of the wiping action by the wiper blade 30 is solved by incorporating a backstop receptacle 16 on the exterior surface of the bottom wall 12 of the ink tank support structure 10 at a location immediately downstream from the printhead nozzle face 14 and spaced therefrom, so that the residual ink 41 that is flicked from the distal end of the wiper blade when the wiper blade is released from contact with the printhead nozzle face is directed into the open side 28 of the backstop receptacle, as indicated by arrows 43. In this FIG. 4, the wiper blade is shown in solid line immediately prior to release of contact with the frame member 24 which surrounds the printhead nozzle face 14 and is shown in dashed line immediately after release of contact with the frame member with the straightening of the deformed wiper blade catapulting or flicking the removed residual ink into the backstop receptacle.

Figure 5:
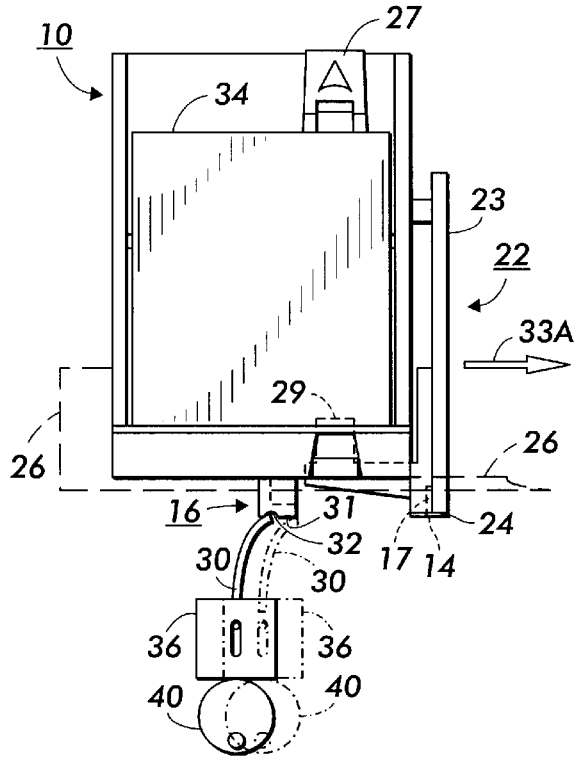
FIG. 5 is a view similar to FIG. 3 showing that continued translation of the carriage causes the wiper blade to contact the backstop receptacle and be cleaned thereby.
Figure 6:
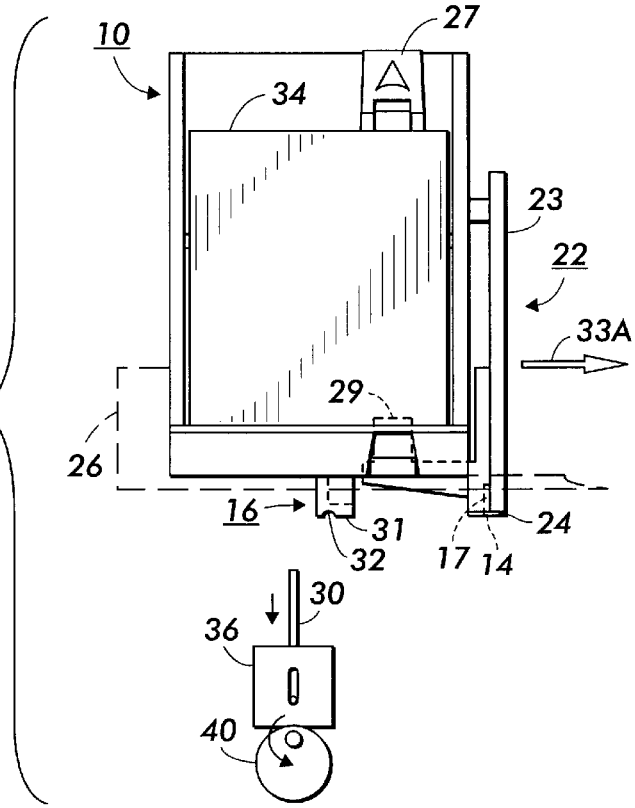
FIG. 6 is a view similar to FIG. 5 showing the completion of the wiper blade cleaning and relocation of the positionable holder and wiper blade.

In FIG. 5, a view that is similar to FIG. 4, except a short time later has past as the carriage continues to translate towards the printing location in the direction of arrow 33A. At this instant in time, the wiper blade is shown in dashed line as it has just contacted the open side 28 of the backstop receptacle 16. The wiper blade has already flicked a major portion of the removed residual ink from the wiper blade as described above in FIG. 4, but still has some residual ink adhering to it. Continued movement of the carriage 26 towards the printing location moves the wiper blade further along the surface of the top wall 31 of the backstop receptacle 16 causing the wiper blade to scrape the residual ink, which is on the wiper blade, into the open side of the backstop receptacle and be cleaned thereby. Later, the wiper blade 30, which is flexingly deformed against the surface of the top wall 31 continues to move past and across groove 32 in the top wall of the backstop receptacle, so that the distal end of the wiper blade is scraped again to ensure complete cleaning of the residual ink from the wiper blade.

The wiper blade holder 36 is repositioned to the non-wiping position by a camming action of the carriage 26 as the carriage continues to move in the direction of the printing location as indicated by arrow 33*a*. Alternatively, the wiper blade holder remains in the wiping position until the carriage returns from the printing location to the non-printing location as depicted in FIG. 2 where the carriage translation in this direction causes the withdrawal of the wiper blade holder 36 from the wiping position to the non-wiping position until the wiper blade 30 is located between the ink tank support structures 10 and 11, whereupon the wiper blade holder is permitted to be moved toward the carriage and position the wiper blade in the wiping position as shown in FIG. 2.

Although the foregoing description illustrates the preferred embodiment, other variations are possible and all such variations as will be apparent to those skilled in the art are intended to be included within the scope of this invention as defined by the following claims.

What is claimed is:

1. A method of removing residual ink from an ink jet printhead nozzle face with a wiper blade, collecting residual ink removed, and cleaning residual ink from said wiper blade, comprising the steps of:

attaching a printhead having a nozzle face to an ink tank support structure, said support structure having a bottom wall;

providing a backstop receptacle integrally formed on the bottom wall of said support structure adjacent the printhead, said backstop receptacle having an open side spaced from and confronting the printhead, said backstop receptacle having a top wall substantially parallel to the bottom wall of the support structure;

installing said support structure on a translatable carriage;

translating said carriage along a path between a printing location and a non-printing location;

providing a positionable wiper blade holder with a relatively stiff wiper blade therein at said non-printing location, the blade holder being positionable between a non-wiping position and a wiping position;

translating said carriage having the support structure with the backstop receptacle and printhead thereon along said path in a first direction from the printing location to the non-printing location;

elevating the blade holder with the wiper blade from the non-wiping position towards the carriage path to said wiping position in response to the movement of the carriage in said first direction;

translating said carriage along said path in a second direction from the non-printing direction towards the printing location, so that the wiper blade contacts said nozzle face and is flexingly deformed thereby;

removing the residual ink from said nozzle face and at least partially onto said flexingly deformed wiper blade as said wiper blade is moved past said nozzle face, thereby wiping said nozzle face clean;

flicking at least some of the removed residual ink from said wiper blade as said wiper blade is moved out of contact with said nozzle face, whereby said wiper blade straightens out from being flexingly deformed;

collecting said at least some of the residual ink flicked from said wiper blade into said backstop receptacle through the open side thereof; and continuing to move the nozzle face in said second direction until said wiper blade is placed into flexingly deformed contact with the top wall of said backstop receptacle, so that a portion of said wiper blade is wiped against the top wall of said backstop receptacle, thereby cleaning all remaining residual ink therefrom.

2. The method as claimed in claim 1, wherein the method further comprises the steps of:

providing a replaceable wiper blade for said blade holder having a distal end which contacts and cleans residual ink from the printhead nozzle face;

positioning said wiper blade holder so that the wiper blade distal end is in the non-wiping position while said printhead nozzle face is being moved by said carriage in said first direction to prevent contact with the backstop receptacle; and positioning said wiper blade holder so that the wiper blade distal end is in a wiping position prior to movement of the printhead nozzle face by said carriage In said second direction from the non-printing location.

3. The method as claimed in claim 2, wherein the method further comprises the step of:

providing a groove on a surface of the top wall of the backstop receptacle, which groove is perpendicular to the first and second directions, so that continued movement of the printhead nozzle face by the carriage in said second direction causes the distal end of the wiper blade to be cleaned a second time by said groove.

4. In an ink jet printer having a translatable printhead with nozzles in a nozzle face from which Ink droplets are ejected therefrom, said printer having means to translate the printhead, a wiper blade means for removing residual ink from the printhead nozzle face, comprising:

said wiper blade means including a wiper blade replaceably mounted at one end in a positionable blade holder and having a free, opposing distal end for cleaning the nozzle face;

said printhead being attached to a removable ink tank support structure, said structure being selectively translated along a path between a printing location and a non-printing location;

said positionable holder being located adjacent the non-printing location and being extendably positionable from a non-cleaning position to a cleaning position, the positioning of said blade holder being in a direction to elevate the blade holder towards the carriage path for said wiping position and to lower the blade holder away from said carriage path for said non-wiping position;

means for selectively elevating said positionable holder from said non-cleaning position to said cleaning position and returning the holder to said non-cleaning position, so that said wiper blade distal end relatively stiffly contacts the printhead nozzle face and is deformed thereby, when the ink tank structure with the printhead is translated from the non-printing location towards said printing location, the wiper blade distal end wiping residual ink from the nozzle face during deformed contact therewith as said ink tank structure is being translated;

a backstop receptacle for collecting residual ink flicked from the distal end of the wiper blade when the ink tank structure is translated toward the printing location from the non-printing location, the backstop receptacle being formed on the ink tank structure and having an open side and a top wall, said open side of the backstop receptacle being spaced from and confronting the printhead, when said deformed wiper blade is moved out of contact with the nozzle face, the wiper blade distal end straightens out after being deformed during contact with the printhead nozzle face and flicks residual ink from the distal end of the wiper blade into the backstop receptacle through said open side thereof; and said structure translation toward the printing location being continued, so that said wiper blade distal end contacts the top wall of said backstop receptacle and is deformed thereby as said wiper blade distal end wipes across the top wall of the backstop receptacle, thereby cleaning the remaining residual ink therefrom into said backstop receptacle through said open side thereof.

5. The ink jet printer as claimed in claim 4, wherein the backstop receptacle is integral with said ink tank support structure.

6. The ink jet printer as claimed in claim 4, wherein the positionable blade holder is positioned by translation of said ink tank support structure.

7. The ink jet printer as claimed in claim 4, wherein the top wall of said backstop receptacle has a groove which is perpendicular to the translation direction of the ink tank support structure, so that continued translation of the ink tank support structure from the non-printing location towards said printing location causes the distal end of the wiper blade to be cleaned thereby a second time.

8. An ink jet printer having a printhead with nozzles in a nozzle face and means for cleaning residual ink from the printhead nozzle face, comprising:

an ink tank support structure having the printhead attached thereto, said support structure having a bottom wall;

a backstop receptacle formed on the bottom wall of the support structure, said backstop receptacle having an open side spaced from and confronting the printhead, said backstop receptacle having a top wall substantially parallel to the bottom wall of the support structure;

a translatable carriage being translatable along a path between a printing location and a non-printing location, said support structure being installed on said carriage for translation therewith;

a positionable wiper blade holder with a replaceable relatively stiff wiper blade therein, said blade holder being located at said non-printing location, the blade holder being positionable between a non-wiping position and a wiping position, the positioning of said blade holder being in a direction to elevate the blade holder towards the carriage translation path for said wiping position and to return the blade holder away from the carriage translation path for said non-wiping position;

means for selectively translating said carriage having the support structure with said backstop receptacle and printhead thereon along said path in a first direction from the printing location to the non-printing location or in a second direction from the non-printing location to the printing location;

said blade holder being elevated from said non-wiping position to a wiping by movement of the carriage in said first direction after passage of the support structure past said blade holder;

when said carriage is being moved along said path in a second direction from the non-printing location towards the printing location, the wiper blade in said blade holder contacts the printhead nozzle face and Is flexingly deformed thereby, and continued movement of the carriage in said second direction wipes the deformed wiper blade across the printhead nozzle face and removes any residual ink thereon, so that once the printhead nozzle face is moved out of contact with the wiper blade, the wiper blade straightens and returns to the wiper blade's original shape, thereby flicking residual ink from the wiper blade into the backstop receptacle through said confronting open side thereof; and continued movement of said carriage in said second direction moves the wiper blade into contact with the top wall of said backstop receptacle, deforming said wiper blade as the wiper blade is wiped against said top wall, thereby cleaning all remaining residual ink therefrom.

9. The ink jet printer as claimed in claim 8, wherein the top wall of said backstop receptacle has a groove which is perpendicular to the direction of the carriage path, so that continued movement of the carriage in said second direction causes the wiper blade to cross said groove and be cleaned thereby a second time.

10. The ink jet printer as claimed in claim 9, wherein continued movement of the carriage in said second direction towards the printing location repositions the blade holder to the non-wiping position.

* * * * *